United States Patent [19]

Eriksson et al.

[11] 4,257,577

[45] Mar. 24, 1981

[54] MOTOR VEHICLE WINCH

[75] Inventors: Erik Eriksson; Lennart Geschwind, both of Vansbro, Sweden

[73] Assignee: Sepson Aktiebolag, Vansbro, Sweden

[21] Appl. No.: 966,954

[22] Filed: Dec. 6, 1978

[30] Foreign Application Priority Data

Dec. 6, 1977 [SE] Sweden ..... 7713838

[51] Int. Cl.[3] ..... B66D 1/24

[52] U.S. Cl. ..... 254/344; 74/801; 192/96; 192/114 R; 192/48.91; 254/348

[58] Field of Search ..... 254/166, 187.6, 187.8, 254/150 FH; 242/86.5 R; 192/96, 114 R, 48.91; 74/340, 355, 801, 805

[56] References Cited

U.S. PATENT DOCUMENTS

| | | | |
|---|---|---|---|
| 2,340,543 | 2/1944 | Magee | 254/166 |
| 2,389,177 | 11/1945 | Ball | 254/187.6 |
| 2,435,353 | 2/1948 | Hite | 254/187.6 |
| 3,726,801 | 4/1973 | Sterner et al. | 254/160 FH X |
| 3,946,991 | 3/1976 | Eriksson | 254/166 |

*Primary Examiner*—John M. Jillions

*Attorney, Agent, or Firm*—Schulyer, Banner, Birch, McKie & Becket

[57] ABSTRACT

A winch having a drum and a gearbox, wherein the gearbox houses planetary gearing for driving the drum, and a coupling device for selectively changing the rotational speed of the drum. The coupling device comprises two interconnected dog elements which are rotatable by the winch motor and are positionable along the rotational axis of the drum at three locations to variously engage the drum and/or gearing for a selected drum speed.

2 Claims, 3 Drawing Figures

MOTOR VEHICLE WINCH

The present invention relates to a winch for motor vehicles which includes a drum and a driving motor connected thereto, the drum and the motor being mounted on one of the side support beams extending in the longitudinal direction of the vehicle chassis.

When mounting a so-called side-mounted winch on a motor vehicle it is often difficult to find a suitable position for the winch because the space between the side support beams of the chassis especially on trucks and military vehicles is occupied by a plurality of different equipment, such as motors, gear boxes, exhaust and hydraulic systems, etc. For instance, it has not been possible to mount a winch of the kind marketed by the applicant under the designation 18-05 and shown in a brochure "Sepson 18-05" on certain motor vehicles because the drum driving motor had no room between the side support beams of the chassis. Moreover, it is a disadvantage that the drum driving motor will not be easily accessible if said winch after all might be mounted on the vehicle.

Attempts have been made to overcome this problem by utilizing a space for the mounting of the winch in the chassis which normally is not occuppied, namely the space in any of the cross beams connecting the side support beams with each other. A winch mounted in such a manner is shown in U.S. Pat. No. 3,946,991. Even if the drum and the driving unit of this winch are easily accessible and the winch has other advantages it is disadvantageous for different reasons to connect the drum and the motor via a long shaft extending between and through both side support beams. Moreover, the location of the winch exactly is bound to the normal cross beams of the chassis.

An object of the present invention is to remove the disadvantages of the previously known winches and to provide a winch which may be detachably mounted substantially anywhere on the outside of any of the side support beams of a vehicle chassis and which consists of a drum and a drum driving motor therefor which are easily accessible from the outside of the vehicle chassis.

Another object is to provide a winch including a gear unit to be easily operable to rotate the drum with the desired speed.

The above objects are fulfilled by the winch according to the present invention having the features described in the claims.

Figure 1:
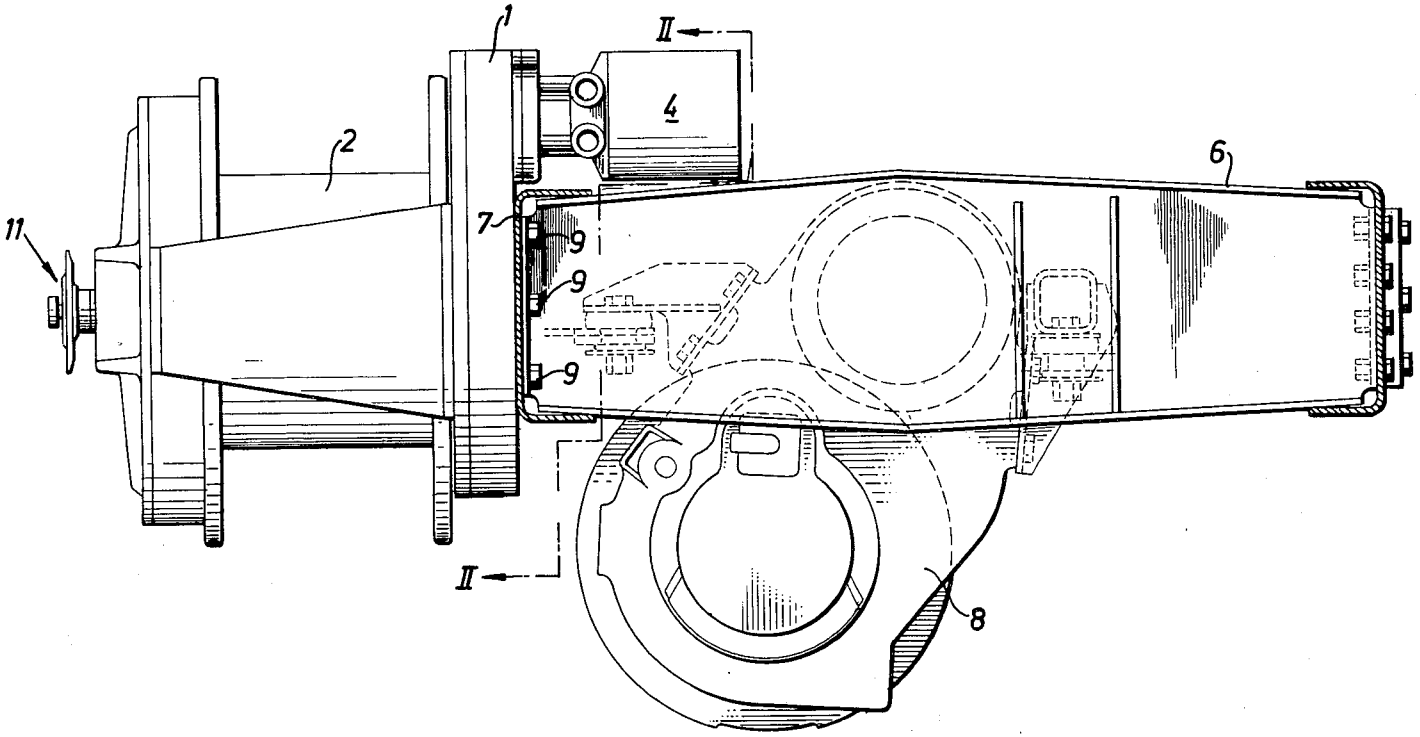
Figure 2:
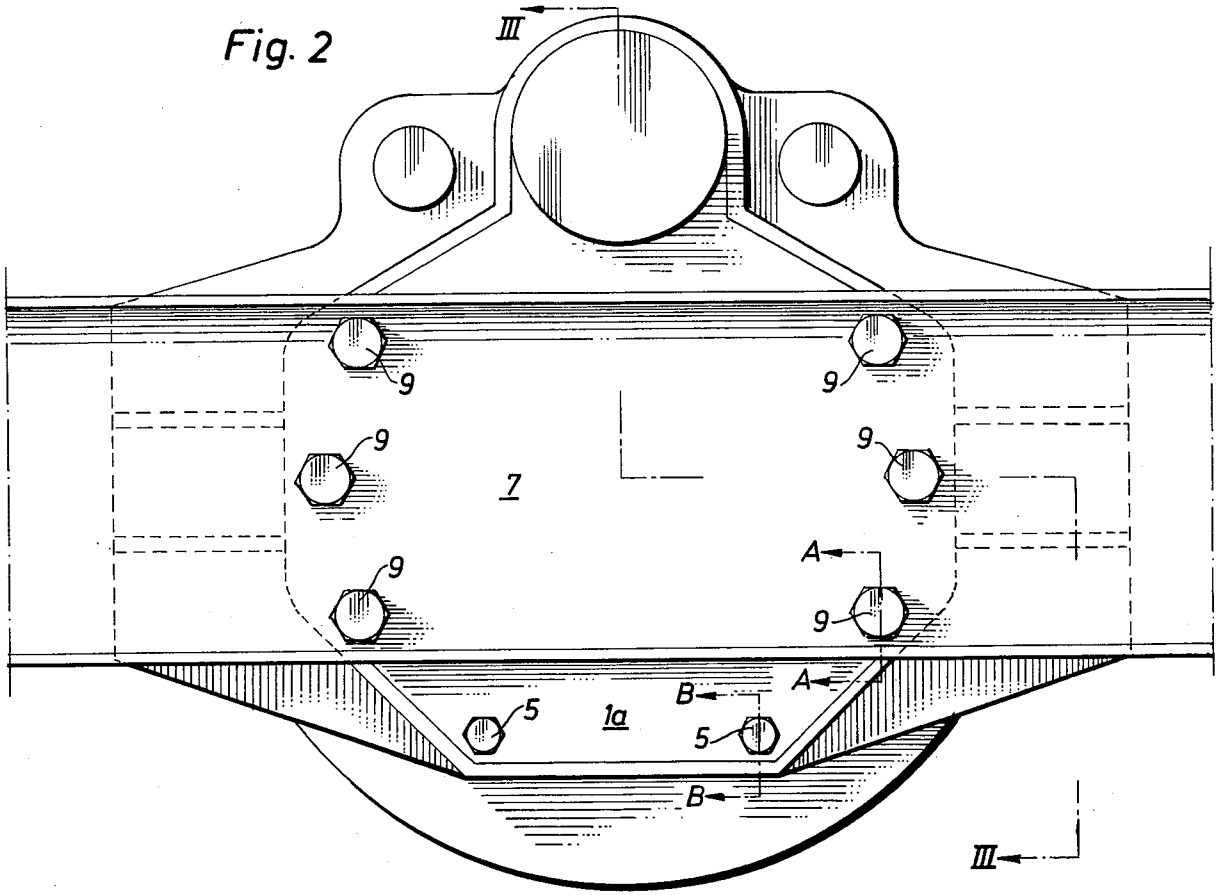
Figure 3:
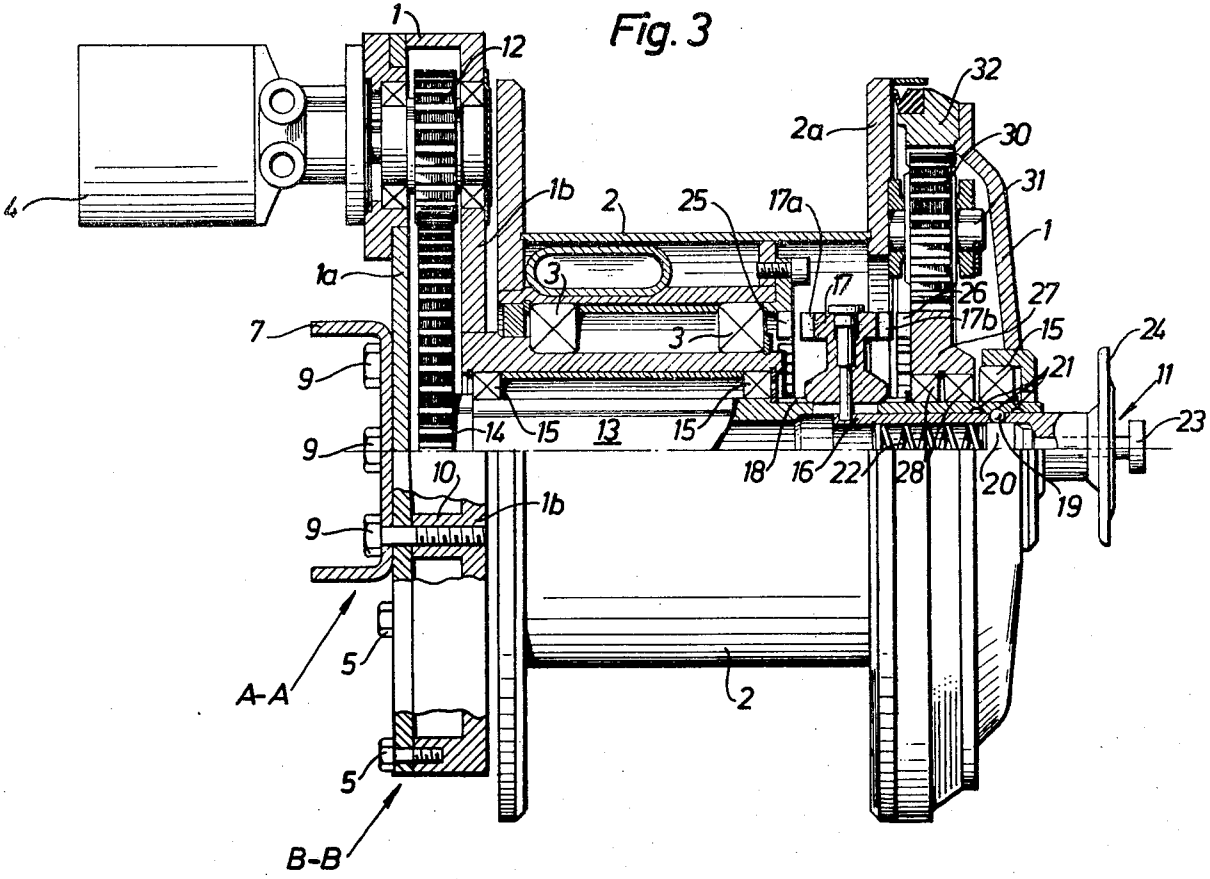

A preferred embodiment of the invention will now be described in conjunction with the enclosed drawings on which FIG. 1 is a side view of the winch according to the invention mounted on a vehicle chassis, a part of which is shown in section, FIG. 2 is a sectional view substantially along line II—II in FIG. 1, and FIG. 3 is a sectional view substantially along line III—III in FIG. 2 and also showing partial sections substantially along lines A—A and B—B in FIG. 2.

The principal parts of the winch shown in FIG. 1 comprise a gear box 1, a drum 2 rotatably supported on a portion of the gear box by means of bearings 3, a hydraulic motor 4 in a suitable manner mounted on the upper portion of the gear box so that it protrudes in a direction from the drum, and a gear unit to be further described below.

A gable 1*a* is screwed to the gear box 1 by means of a plurality of bolts 5 (two are shown in FIG. 2 and two are shown in FIG. 3). The gable 1*a* and a strong portion 1*b* of the gear box are mounted to one of the elongated outer U-formed side support beams 7 of the chassis 6 of a vehicle. The beams 7 and cross beams (not shown) connected thereto support a number of different devices, i.e. a vehicle engine with gear box 8. The connecting elements between the support beam 7 and the winch consist of six identical bolts 9 introduced through holes in the web of the side beam 7 and in holes in the gable 1*a*. The threaded portions of the bolts engage with threaded holes in the portion 1*b* of the gear box (see FIG. 3, section A—A). To make the construction rigid spacing sleeves 10 have been inserted between the gable 1*a* and the gear box portion 1*b*. The sleeves 10 surround the bolts 9 and are suitably integral with the gear box portion 1*b*.

When the winch is to be mounted on the beam 7 it is seen to it that the holes in the web thereof and the holes in the gable 1*a* are aligned. Thereafter, the bolts 9 are inserted into these holes and through the sleeves 10 and are screwed into threaded holes in the gear box portion 1*b*. When demounting the winch from the side beam 7, which may be necessary for maintenance, repair or removal of the winch from the side beam 7 to the other side beam or to another vehicle, for instance, the bolts 9 only need to be unscrewed from the threaded holes in the portion 1*b* and removed from the holes in the gable 1*a* in order to loosen the winch.

The gear box 1 contains a two speed gear unit which is manually operable by the coupling device 11 shown to the right in FIG. 3 and to the left in FIG. 1. The gear unit consists of a planetary gearing driven by the hydraulic motor 4. For this purpose the motor 4 is provided with a gear 12 which is rotatably supported on the gear box 1 and which drives a gear 14 which is located between the gable 1*a* and the gear box portion 1*b* and which is fixed to a central hollow shaft 13. The shaft 13 is supported in bearings 15 fastened to the gear box 1. Within the hollow shaft 13 a sleeve 16 is movable in the longitudinal direction thereof. A wheel 17 forming a part of a toothed coupling and having two opposed dogs 17*a* and 17*b* is fixed to the left end of the sleeve 16. The wheel 17, which is provided with a central aperture, is slidable in the longitudinal direction of the shaft on splines 18 formed on the periphery of the shaft and may take up any one of three positions. In the wall of the sleeve 16 there is one or more holes containing balls 19 (only one is shown). The balls 19 are kept in their places in the wall of the sleeve by means of a body 20 formed as a piston which fits in the sleeve and makes contact with the balls, and by means of any of three recesses 21 in the hollow shaft 13. Normally, the body 20 has the position shown in FIG. 3 and may be displaced to the left against the action of a compression spring 22 by pressing a button 23 formed as a portion of the body 20. At such a displacement the periphery of the body 20 will be removed from the balls 19 so that the latter are able to leave their recesses 21. By means of a disc 24 connected to the sleeve 16 and protruding out from the gear box the sleeve may be displaced manually in the hollow shaft 13 to take up a new position wherein the balls are located in front of another of the three recesses 21. When the sleeve 16 is in the new position the button 23 is released so that the body 20 takes up its normal position blocking the balls.

In the position shown in FIG. 3 the sleeve 16 takes up an intermediate position wherein the dogs 17*a* and 17*b* on the wheel 17 connected to the sleeve do not engage with any other means. When the sleeve 16 takes up its left end position and, thus, the balls 19 are positioned in the recess 21 shown to the left in FIG. 3, the dogs 17*a* engage corresponding dogs 25 fixed to the drum 2. When the hollow shaft 13 and the wheel 17 rotate the latter will bring the drum 2 with it so that the latter will rotate too. When the sleeve 16 is in its right end position and the balls 19 thus are located in the recess 21 to the right in FIG. 3, the dogs 17*b* engage corresponding dogs 26 on a sun gear 27 in the planetary gearing. The sun gear 27 is rotatably supported on the hollow shaft 13 by means of bearings 28 and engages with preferably three planet gears 30 (only one is shown) rotatably supported on shaft 31 fixed to the right gable 2*a* of the drum 2. The planet gears 30 engage an inner cog railway on a ring wheel 32 fixed to the gear box. When the sun gear 27 rotates the planet gears 30 will get a rotational and planetary motion so that the drum, via the shafts 31, rotates with a velocity which is less than the velocity with which the drum rotates when the wheel 17 is in direct engagement with the drum via the dogs 25 thereon.

Even if only one embodiment of the invention has been described above and shown on the drawings if should be understood that the invention is not limited to this embodiment but is only limited to that which is stated in the claims.

We claim:

1. Winch having a rotatable drum, a driving motor and a gear box containing a planetary gearing comprising gears driving the drum, the planetary gearing or the drum being selectively operable by a coupling device to change the rotational speed of the drum, the coupling device comprising two dog elements which are connected to each other, rotatable by the motor and displaceable along the rotational axis of the drum to take up any of three positions in relation to the drum, in the first position one of the dog elements engaging a dog element fixed to the drum, in the second position the other dog element engaging a sun gear of the planetary gearing, the sun gear transferring rotational motion to the drum via planet gears and a ring wheel, one of said planet gears or said ring wheel being connected to the drum, and in the third position none of the two dog elements of the coupling device engaging the dog element of the drum or the sun gear.

2. Winch according to claim 1, wherein the dog elements of the coupling device are connected to a manually operable element displaceable along the rotational axis of the drum and comprising a sleeve in which a body is displaceably supported and wherein at least one ball supported by the sleeve is normally forced by the outer surface of the body into one of three recesses in an axially immovable portion of the gear box so that the sleeve is axially locked to said portion, the body being displeaceble to a position where it does not engage the ball in order that the latter shall be moved out from one of said recesses whereby the sleeve and thus the dog elements may be displaced to another position.

* * * * *